United States Patent [19]

Fisher et al.

[11] Patent Number: 4,486,994

[45] Date of Patent: Dec. 11, 1984

[54] PANEL WALL CONSTRUCTION HAVING AIRTIGHT JOINT AND METHOD OF FORMING SAME

[75] Inventors: Gary H. Fisher; H. Patrick Padgett, both of Rockingham, N.C.

[73] Assignee: Industrial Sheet Metal & Mechanical Corp., Rockingham, N.C.

[21] Appl. No.: 241,725

[22] Filed: Mar. 9, 1981

[51] Int. Cl.[3] ..... E04B 1/00

[52] U.S. Cl. ..... 52/303; 52/309.4; 52/305.9; 52/744; 264/46.5

[58] Field of Search ..... 52/303, 309.9, 309.11, 52/282, 265, 434, 435, 741, 743, 127.4, 744, 309.5, 309.3, 127.4; 264/46.5

[56] References Cited

U.S. PATENT DOCUMENTS

| | | | |
|---|---|---|---|
| 2,934,180 | 4/1960 | Hammitt et al. . | |
| 3,038,568 | 6/1962 | Morgan . | |
| 3,182,423 | 5/1965 | Jennings | 52/127.1 |
| 3,192,671 | 7/1965 | Smith | 52/434 |
| 3,233,379 | 2/1966 | Zagray | 52/744 |
| 3,251,912 | 5/1966 | Fish . | |
| 3,300,931 | 1/1967 | Lutze . | |
| 3,323,267 | 6/1967 | Fish . | |
| 3,332,170 | 7/1967 | Bangs | 52/309.11 |
| 3,375,627 | 4/1968 | Bursiek et al. . | |
| 3,503,172 | 3/1970 | Beguin . | |
| 3,566,568 | 3/1971 | Slobodia | 52/309.9 |
| 3,583,118 | 6/1971 | Lowery . | |
| 3,733,102 | 5/1973 | Serino et al. | 52/282 |
| 3,798,869 | 3/1974 | Nipp . | |
| 3,854,260 | 12/1974 | O'Hanlon . | |
| 4,030,263 | 6/1977 | Lancombe . | |
| 4,137,680 | 2/1979 | Doonan . | |
| 4,296,540 | 10/1981 | Potter | 52/309.5 |

FOREIGN PATENT DOCUMENTS

| | | | |
|---|---|---|---|
| 2225591 | 8/1974 | France | 52/282 |
| 2287559 | 5/1976 | France | 52/265 |

*Primary Examiner*—Henry E. Raduazo

*Attorney, Agent, or Firm*—Bell, Seltzer, Park & Gibson

[57] ABSTRACT

Joints in a panel wall construction are provided with an internal seal of greatly enhanced airtightness and of enhanced structural strength. This is achieved by forming the panels with the core thereof recessed inwardly from the edges of the skins so that when the panels are positioned in assembled relation in a channel member, a longitudinally extending cavity is provided between the skins. A hardenable filler material, such as foam, is injected into the cavity to completely fill the cavity as well as any cracks or gaps which may exist between the channel member and the skins of the panel.

17 Claims, 11 Drawing Figures

PANEL WALL CONSTRUCTION HAVING AIRTIGHT JOINT AND METHOD OF FORMING SAME

FIELD AND BACKGROUND OF THE INVENTION

This invention relates to a panel wall construction, and more particularly relates to an arrangement and method for producing an improved joint of enhanced airtightness and structural strength between two adjacent panels.

Various types of buildings and enclosures utilize preformed panels held together in assembled relationship by channel members which extend between and interconnect adjacent panels. For example, this type of panel wall construction is commonly used in housings for air handling units and related heating and air conditioning equipment. Typically in such applications, the panels have an insulated core formed of insulated foam or other suitable insulation material, with a pair of parallel skins on opposite sides of the core defining the exterior surfaces of the panels. The channel members are designed for either joining together adjacent panels in longitudinal alignment with one another or for joining the panels together at right angles.

Since air conditioning equipment housings typically operate at either a positive or negative atmospheric pressure, it is necessary to provide some type of seal to prevent air leakage through the joints between adjacent panels. Heretofore in this type of panel wall construction, the joints have been sealed by applying caulking externally of the housing along the juncture between the channel member and the skin of the panel. However, with this approach it is quite difficult to obtain a completely airtight seal. Additionally, since the caulking is exposed on the outside of the housing, it is subject to weathering and degradation, and problems with air leakage in such housings tend to increase with the age of the housing.

SUMMARY OF THE INVENTION

With the above-mentioned problems in mind, we have developed a panel wall construction and method of forming the same which presents very significant advantages over the prior practices. The present invention provides a means and method for obtaining a much more reliable and airtight seal along the panel joints than has heretofore been possible. Panel joints utilizing the seal arrangement of this invention are thus particularly suited for use in high differential pressure applications, where problems with air leakage are most acute. In this regard, the newer and more efficient heating and air conditioning systems which are being produced operate at increasingly high pressure differentials. While many older commercial systems operate at a differential pressure of about 1 to 4 inches of water, the newer and more efficent systems typically operate at a pressure of from 8 to about 20 inches of water. The higher differential pressures utilized in these systems make it increasingly difficult to obtain an effective airtight seal by conventional means.

In addition to having greatly enhanced airtightness, panel joints sealed in accordance with the present invention have a much greater structural strength and contribute significantly to the overall strength and stability of the wall construction. Additionally, panel walls which have been sealed in accordance with the present invention provide a significant reduction in sound transmission. This is of very significant importance in heating, ventilating and air conditioning applications. Also, in accordance with the present invention the seal is located internally of the panel joint and is thus more permanent and is not subject to weathering and degradation as in the prior conventional joint constructions.

Broadly, the improved panel joint of the present invention is achieved by forming an internal cavity where two adjacent panels are joined together by an elongate channel member, and by injecting a hardenable filler material into the cavity so as to fill the cavity as well as any cracks or gaps which might exist between the channel member and adjacent portions of the panels.

More specifically, the panels which are used in this type of panel wall construction have a core with a pair of skins on opposite sides of the core defining the exterior surfaces of the panels. In conventional panel constructions, the edges of the core and skins are co-extensive along the perimeter of the panel. However, in accordance with the present invention, the panels are formed with the core thereof recessed inwardly from the edges of the pair of skins. Two adjoining panels are positioned in a channel member with the projecting longitudinal edge portions of the skins thereof extending into the channel member and with the recessed cores thereof forming an internal cavity extending longitudinally of the channel member. A hardenable filler material is injected into this cavity so as to fill the cavity as well as any cracks or gaps which may exist between the channel member and the skins of the panel to thereby produce an airtight internal seal at the joint between the pair of panels. Preferably, the filler material comprises a hardenable expandable foam insulating material. This expandable foam is injected into the cavity in a liquid state and is allowed to foam and expand many times its original volume, and in so doing forcing itself into all available cracks or crevices in the joint, thereby forming a highly effective airtight joint. Once the expandable foam material hardens, it adheres tenaciously to all adjacent surfaces of the channel member and panel, thereby providing enhanced structural strength in the joint.

BRIEF DESCRIPTION OF THE DRAWINGS

Some of the features and advantages of the invention having been stated, others will become apparent as the description proceeds, when taken in connection with the accompanying drawings, in which—

DESCRIPTION OF ILLUSTRATED EMBODIMENTS

Figure 1:
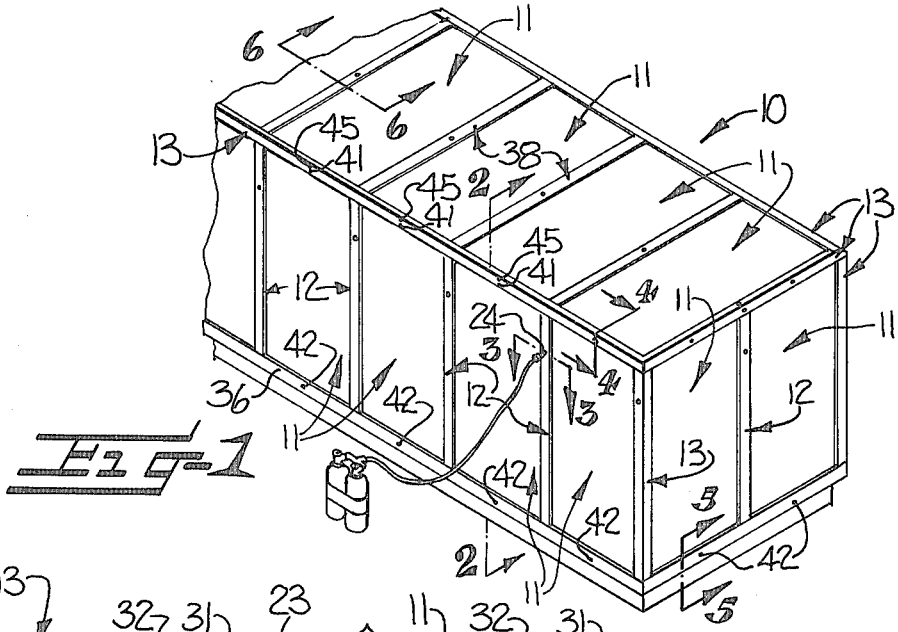
FIG. 1 is a perspective view of an enclosure formed of insulated panels, and wherein the joints between adjoining panels are sealed pursuant to this invention.

Referring now more particularly to the drawings, in FIG. 1 there is illustrated an insulated enclosure 10 of a type suitable for use as an air conditioning equipment housing. The enclosure 10 is formed by a plurality of insulated panels 11 arranged edge to edge, with the edges of adjacent panels extending parallel and in closely spaced relation to one another and being received in and interconnected by respective elongate channel members.

Figure 3:
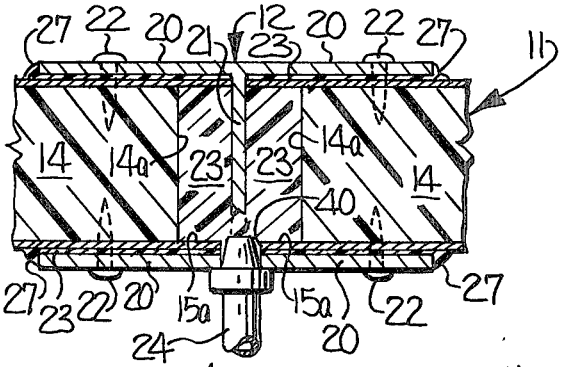
FIG. 3 is a horizontal cross sectional view taken substantially along the line 3—3 of FIG. 1 and, showing the joint between two adjoining upright panels.

The channel members, more particularly, are of several different cross sections, as best seen in FIGS. 3 to 6. As shown in FIG. 3, the channel members 12 are of a generally H-shaped cross section and are adapted for receiving and interconnecting two adjacent panels 11 in longitudinal alignment with one another. The H-shaped channel members 12 extend between and interconnect the panels 11 forming the side walls of the enclosure 10.

Figure 4:
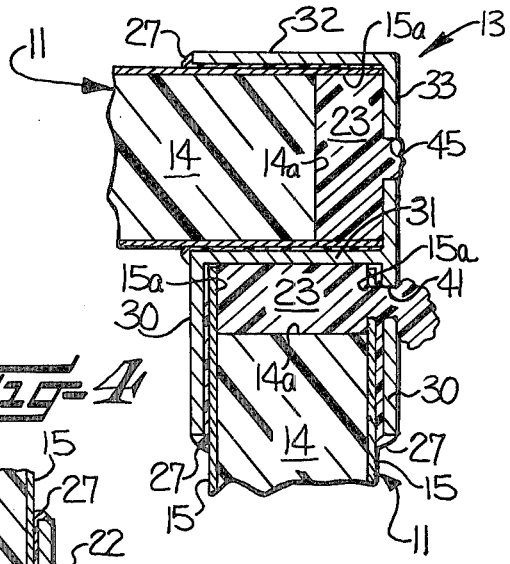
FIG. 4 is a cross sectional view taken substantially along the line 4—4 of FIG. 1 and showing the joint between the wall and roof panels.

The channel members 13 shown in FIG. 4 are of a generally C-shaped cross section and are adapted for receiving and interconnecting two adjacent panels at right angles to one another. The channel members 13 are provided in the enclosure at the corners where adjacent side walls intersect, and along the top edge of the enclosure where the roof panels join the side wall panels.

Figure 7:
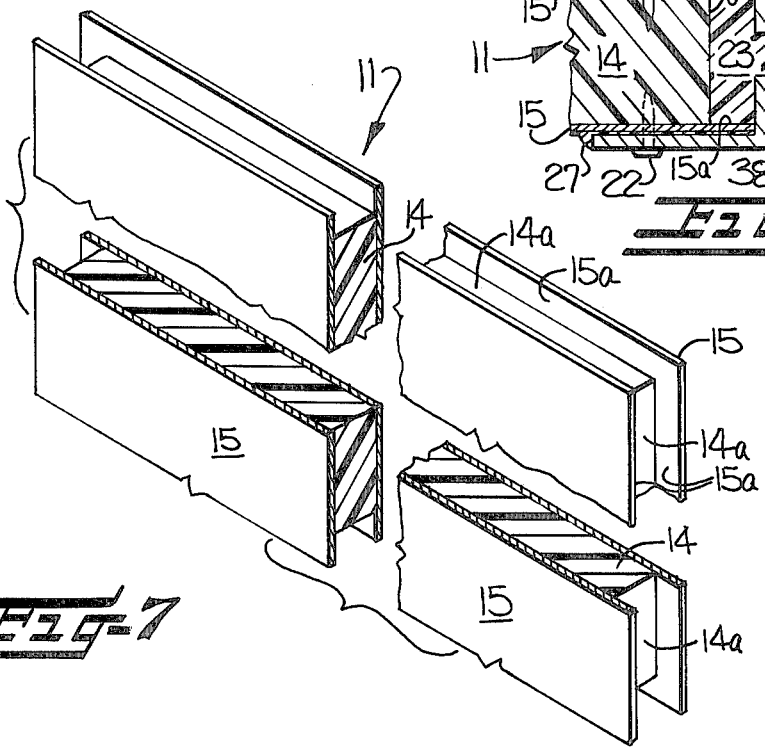
FIG. 7 is a perspective view, with portions broken away, showing one of the insulated panels.

The insulated panels 11, as best seen in FIG. 7, have an insulating core 14 formed of an expanded rigid foam insulating material, such as polyurethane foam, and have a pair of parallel skins 15 on opposite sides of the core 14 defining the exterior surface of the panels. In the embodiment illustrated in FIG. 7, the skins 15 are formed of thin sheet metal, such as aluminum for example, and are bonded to the foam core 14 to form an integral structural panel. The longitudinal edges **14*a* of the foam core are recessed inwardly a short distance from the edges 15*a*** of the skins for purposes which will become apparent as the description proceeds.

Referring now in more detail to the H-shaped cross section channel member 12, as best illustrated in FIG. 3, it will be seen that this channel member comprises two pairs of opposing generally parallel extending legs 20, with the respective legs of each pair being spaced apart a distance corresponding substantially to the thickness of the panel 11. The two pairs of opposing legs 20 extend in longitudinal alignment with one another for interconnecting the pair of panels in longitudinal alignment. The channel member 12 additionaly includes a web portion 21 which extends between and interconnects the two opposing pairs of legs. When the panels 11 are positioned in the channel member 11 and fully received thereby, as illustrated in FIG. 3, the projecting longitudinal edge portions **15*a* of the skins engage the web portion 21. The edge 14*a* of the core 14, being recessed from the edges 15*a* of the skins, forms a longitudinally extended hollow cavity within the channel member 12 on each side of the web portion 21. With the panels 11 so positioned in and received by the channel member 12, the skins 15*a* extend into the channel member and are positioned in opposing contacting relation with the adjacent legs 20 of the channel member. Rivets 22 or other suitable fastening means are used for securing the panels 11 and the channel member 12** together.

In accordance with the present invention, a highly effective airtight and strong joint is achieved between the adjacent panels by filling the longitudinally extending internal cavities with a filler material. As illustrated in FIG. 3, the filler material 23 is injected into the cavities through a nozzle 24 positioned in a hole 40 formed in the channel member. Preferably, the material 23 is injected into the cavities on both sides of the web portion 21 simultaneously by forming the hole 40 so as to penetrate the web portion 21 and thus provide communication with the cavities on both sides of the web portion. The filler material 23 completely fills the cavities, and also tends to fill any cracks or gaps where air leakage could occur, as for example along the interface between the inner surface of the legs 20 and the adjacent opposing surfaces of the skins 15.

Preferably, the filler material which is utilized is a hardenable expandable foam material, such as polyurethane foam. The material is injected into the cavities in a liquid state, and is allowed to foam and expand in situ within the cavities to many times the original volume of the material injected. The pressure created by the expansion of the foam within the confinement of the cavities tends to force the foam material into any available crevices, cracks or potential leakage sites. Upon hardening, the expanded foam material forms an essentially airtight joint. Preferably, a small bead of caulking 27 is provided along the edges of the legs 20. This bead of caulking forms a temporary seal to contain the foam material internally of the joint and to prevent it from extruding to the exterior surface of the wall construction where it could form an unsightly appearance. The expanded foam material, upon hardening, forms a tenacious bond to the surfaces of the foam core 14, channel member 12 and skins 15, thereby providing significantly enhanced structural strength in the joint. A further benefit of this type of internal seal is that it is totally encased within the joint and is therefore not exposed to weathering, and it prevents penetration of moisture into the panel. Also, the enhanced structural strength and rigidity of the joint avoids generation of noise due to vibration, and serves to dampen vibration and noise which may be present in the housing.

The channel member 13 used at the corners of the structure, like the channel members 12 used in the straight wall portions, has two pairs of opposing legs adapted for receiving the respective panels therein. One pair of the opposing legs extends at right angles to the other pair for thus receiving the panels and holding them in assembled relationship at right angles to one another. As illustrated in FIG. 4, one of the pairs of legs is indicated by the reference character 30. The legs 30 are connected by a web portion 31 which also serves as one of the legs of the other pair. The other leg, indicated at 32, extends in opposing generally parallel spaced relation to the portion 31, and with a web portion 33 extending therebetween. When panels 11 are fully received in the channel member with the longitudinal edges 15*a* of the skins of the panels engaging the respective web portions 31 and 33, longitudinally extending cavities are formed on opposite sides of the web portion 31 as a result of the core 14 being recessed from the edges 15*a* of the skins. As in the arrangement shown in FIG. 3, a filler material 23 is injected into the cavities and completely fills the cavities and forms an airtight seal at the joint between the two panels.

Figure 5:
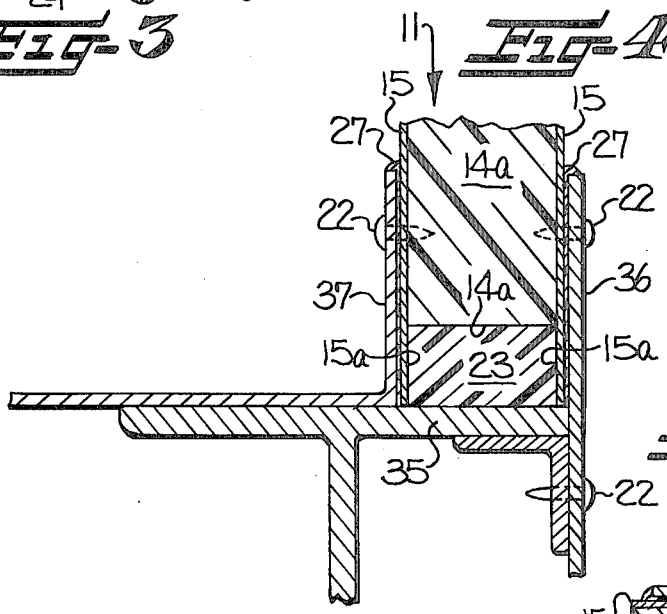
FIG. 5 is a cross sectional view taken substantially along the line 5—5 of FIG. 1 and showing the joint formed along the lower edge of the side wall panels.

FIG. 5 illustrates the sealing arrangement provided along the bottom of the side wall panels. Opposing upstanding members 36, 37 are provided along the lower edge of a base plate 35 of the housing and serve as a channel to define a pair of opposing legs for receiving the panel therebetween. The members 36, 37 are spaced apart a distance corresponding to the thickness of the panel for closely receiving the panel therebetween, and rivets 22 or other suitable fasteners extend through the upstanding members 36, 37 and into the skins 15 of the panels for anchoring the panels in place. The recessed core 14 of the panel defines a longitudinally extending cavity which is filled by the filler material 23. As previously described in connection with FIG. 3, the filler material completely fills the cavity formed between the base plate 35 and the edge 14*a* of the core and also fills any cracks or spaces which may exist between the opposing surfaces of the skins 15 and the upstanding members 36, 37.

Figure 6:
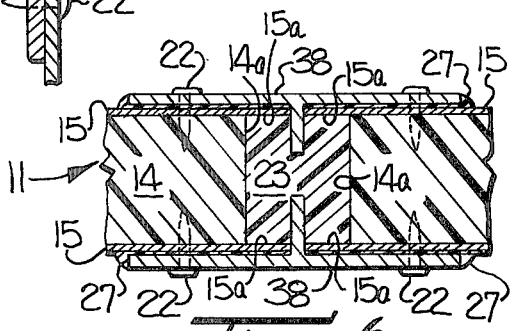
FIG. 6 is a cross sectional view taken substantially along the line 6—6 of FIG. 1 and showing the joint formed between two adjoining roof panels.

The joints between the horizontally oriented panels which form the roof of the enclosure 10 are sealed in a similar manner. These panel joints may utilize an H-shape cross section channel member similar to that shown in FIG. 3 or may utilize a pair of T-shape cross section channel members 38 as shown in FIG. 6, in which case a single longitudinally extending cavity will be formed between the two panels.

Figure 2:
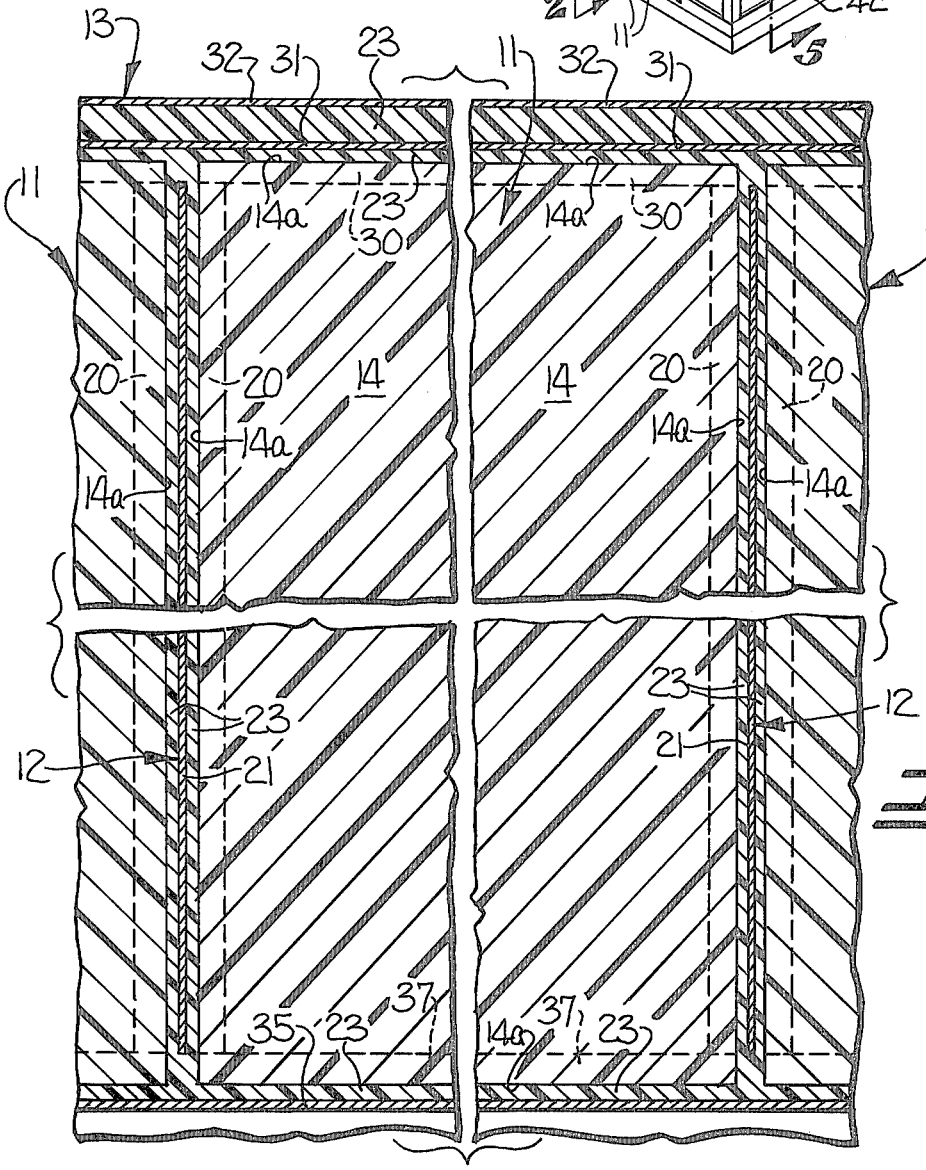
FIG. 2 is a vertical cross sectional view through the panel wall taken substantially along the line 2—2 of FIG. 1.

Referring now to FIG. 2, it should become apparent when viewing the panel wall in cross section that the longitudinally extending cavities formed within the respective channel members between the adjacent recessed edges 14*a* of the panels are interconnected at opposite ends so that the cavities communciate along the entire perimeter of each panel. This is also the case for the panels which form the top wall or roof of the enclosure. This communication between the respective cavities greatly facilitates the filling of the cavities, with filler material, as will now be described.

In producing the strong airtight joints in accordance with the method of this invention, the panels are first assembled in edge to edge relationship, with the respective appropriate channel members 12, 13, 36, 37 or 38 extending therebetween so as to form an enclosure of the desired size and configuration. Suitable fasteners, such as rivets 22, are used for holding the panels and channel members together at the joints. Then a bead of caulking 27 is provided along the juncture between the channel member and the skin of the panel to prevent leakage of the filler material to the outside of the structure as previously described.

In filling the respective cavities which are formed along the perimeter of each panel, a hole is first drilled through the channel member and through the underlying skin so that the filler material can be injected into the cavity. Preferably, at least one additional hole is also formed at a longitudinally spaced location along the cavity. Such additional holes serve as bleed holes to allow air to be displaced from the cavity as the cavity is filled with the filler material, and such holes also serve to provide a visual indication of when the cavity is filled.

FIG. 1 illustrates a suitable arrangement of holes for filling the cavities along the side walls and roof of an enclosure. For filling each panel in the side walls, an injection hole 40 is formed in the H-shaped channel member 12, preferably a short distance below the top edge of the panel, e.g. about one foot below the top edge. Preferably, as illustrated in FIG. 3, this hole 40 penetrates the web portion 21 of the channel member so as to provide communication with the cavities on each side of the web portion. Bleed holes 41, 42 are preferably formed along the top and bottom channels communicating with the cavities therein, and located about midway between the side edges of each panel. Then a nozzle 24 is positioned in the injection hole 40 and a measured amount of the filler material is injected into the cavities.

Preferably, the filler material is an expandable rigid foam material, such as rigid polyurethane foam. Such materials are formed by reacting two components, a polyol and a diiscocyanate. These two materials are mixed together in the nozzle 24 at the point of injection and enter the cavity as a free-running non-viscous liquid. As soon as the measured amount of liquid is injected into the cavity, the nozzle 24 is removed and the injection hole 40 is plugged by a suitable plug. The materials quickly react and foam and expand many times the original volume thus creating a pressure which forces the foam material throughout the series of communicating passageways and into any available void space. As the foam material continues to expand, it displaces air from the cavity though the bleed holes 41, 42 and within a very short period of time the foam material begins to emerge from the bleed holes, thus giving a visual indication that the cavity has been filled. At this point, the bleed holes 41, 42 are also plugged, thus creating even greater pressures within the cavity as the foam material continues to expand. The expansion of the foam material within the confinement of the cavities tend to densify the foam, and the resulting foam material, upon hardening, is generally more dense than the free-rise density of the foam material. By way of example, the free-rise density of a typical commercially available rigid polyurethane foam is about 1.8 pounds per cubic feet, but the density of the foam material within the cavities is on the order of about 3 pounds per cubic feet. The above-described procedure is followed for each of the panels forming the side walls of the enclosure. The roof panels are sealed in a similar manner, with the foam material being injected into the cavities through injection holes 44 at a suitable location, such as in the channel members 38, and with bleed holes 45 being provided at suitable locations spaced from the injection holes, such as in the channel members 13.

Air conditioning equipment housings sealed in accordance with the arrangement and method just described have been found to have an airtightness far exceeding that which has previously been achieved by conventional sealing means. Actual tests have demonstrated that the joint seal of the present invention can withstand a differential pressure as high as thirty-six inches of water over extended periods of time without any leakage. This is considerably higher than the differential pressure typically encountered in air conditioning equipment housing and air handling units.

Figure 8:
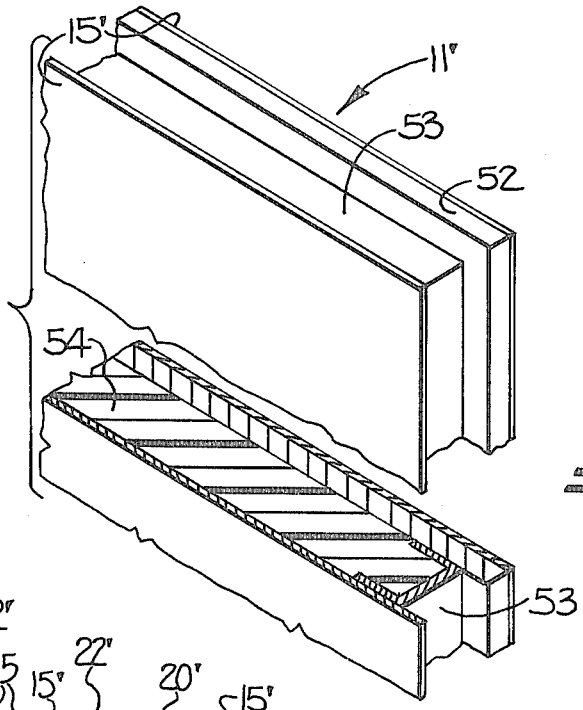
FIG. 8 is a view similar to FIG. 7 showing an alternative type of insulated panel construction.

FIGS. 8 to 11 illustrate the applicablity of the present invention to another type of panel construction using channel members of a somewhat different construction. As illustrated in FIG. 8, the panels 11' have skins 15' formed of sheet metal mounted in parallel spaced apart relation with an insulating core, located therebetween. Underlying the metal skin 15' on one face of the panel is a reinforcing board 52, such as sheetrock, which provides some degree of insulation, but more importantly provides structural reinforcement to the panel and insures obtaining a smooth surface for the overlying metal skin. The two skins 15' are mounted in spaced apart relation from one another by a U-shaped spacer member 53, and the void between the sheetrock panel 52 and the other skin is filled by a suitable insulation material 54, such as fiberglass insulation. The spacer members 53 are recessed from the edges 15*a'* of the skins 15' to form longitudinally extending cavities when the panels 11' are received by channel members.

Figure 9:
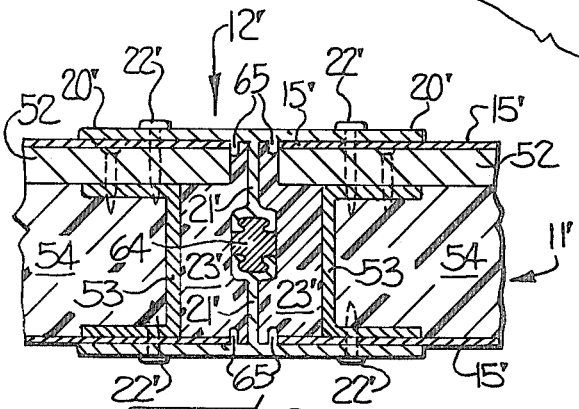
FIG. 9 is a cross sectional view similar to FIG. 3 showing this alternative type of panel construction used in conjunction with an alternative type of channel member.
Figure 10:
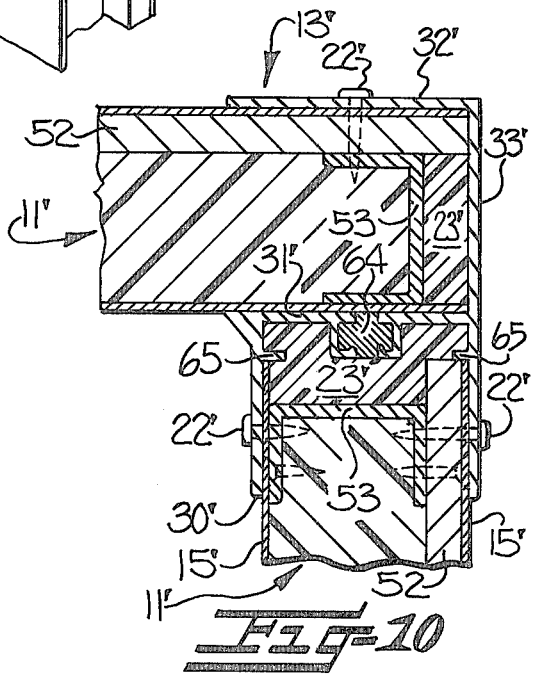
FIG. 10 is a cross sectional view similar to FIG. 4 showing the roof and wall joint for this type of panel and channel member construction.

This type of insulated panel may be used in association with channel members of the type previously described in connection with FIGS. 1 to 7, or in connection with an alternative type of channel 62, 63, members as illustrated in FIGS. 8–10. The channel members 12', 13' are of generally similar cross sectional shape to the channel members 12, 13 previously described, and to avoid repetition, elements of the channel members 12' and 13' which correspond to elements of the channel members 12 and 13 will be identified by corresponding reference characters, with prime notation (') added.

The channel members 12' and 13' are characterized by being of an insulated construction with an insulating bridging member 64 formed in the respective web portions so that the channel members do not provide a path for the conduction of heat or cold from one surface of the panel to the opposite surface. The channel members are further characterized by having respective pairs of abutment stops 65 carried by the legs and spaced outwardly from the web portion. As illustrated, the panels 11' are received in the channel members to a depth such that the edges 15*a'* of the skins 15' engage the abutment stops 65, with the recessed cores of the panels being spaced from the web portion to form respective longitudinally extending cavities on opposite sides of the web portion.

Figure 11:
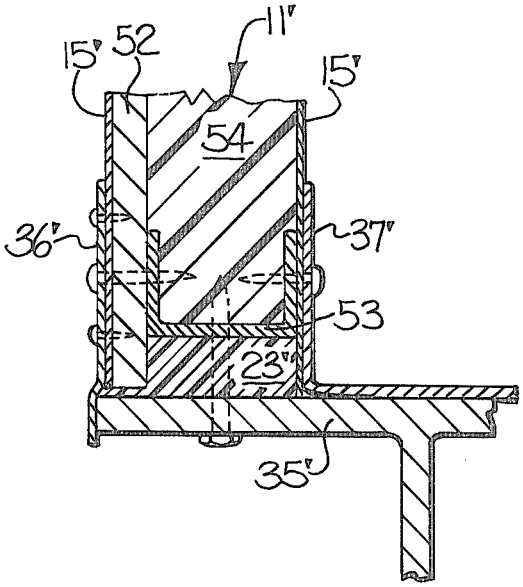
FIG. 11 is a view similar to FIG. 5 showing the joint along the lower edge side wall panels for this alternate type of panel construction.

The sealing arrangement provided along the lower edge of the side walls is illustrated in FIG. 11, and is essentially similar to that illustrated in FIG. 5.

In the drawings and specification, there have been set forth preferred embodiments of the invention, and although specific terms are employed, they are in a generic and descriptive sense only and not for purposes of limitation.

That which is claimed is:

1. A method of forming a strong airtight joint between a pair of adjoining insulated panels having adjacent longitudinal edges positioned in and interconnected by an elongate channel member having respective pairs of opposing spaced apart legs for receiving the panels therebetween and having a web portion extending between and interconnecting the pairs of opposing legs, and the panels each having an insulated core and a pair of parallel skins on opposite sides of the core defining the exterior surfaces of the panel, and said method comprising forming the panels with the insulated core thereof recessed inwardly from the pair of skins along at least one longitudinal edge of the panels, positioning the pair of adjoining panels with the projecting longitudinal edge portions of the skins thereof extending into the channel member and positioned in opposing contacting relation with the adjacent legs of the channel member and with the recessed cores thereof forming respective longitudinally extending internal cavities within the channel member on opposite sides of the web portion, forming a hole in the channel member penetrating the web portion and communicating with the respective cavities on opposite sides of the web portion, injecting a hardenable expandable foam material simultaneously into the respective cavities through said hole and expanding the foam material so as to completely fill the cavities while also filling any cracks or gaps which may exist between the channel member and adjacent portions of the skins of the panels to thereby produce an airtight seal between the pair of panels, whereeby upon hardening of the foam material in the cavities a bond is formed between the channel member and the adjacent portion of the skins to thereby provide enchanced structural strength in the joint.

2. A method as set forth in claim 1 additionally comprising forming at least one additional hole in the channel member communicating with the cavities and positioned at a longitudinally spaced location from said first mentioned hole, and wherein said step of injecting a hardenable expandable foam material into the cavities comprises injecting the foam material into the respective cavities through said firstmentioned hole until the material emerges from said at least one additional hole.

3. A method as set forth in claim 1 additionally comprising positioning respective additional channel members along each of the remaining edges of the panels, each of such additional channel members having a pair of opposing legs receiving the edge of the respective panel therebetween, and wherein the edges of the panels which are received by such additional channel members have the core thereof recessed inwardly from the edges of the skins and forming an elongate internal cavity extending longitudinally of the respective channel member, interconnecting opposite ends of the respective channel members so that the respective elongate cavities formed therein communicate along the perimeter of each panel, and wherein said step of injecting a hardenable expandable foam material into the respective cavities comprises injecting a sufficient quantity of the foam material to fill the communicating cavities along the entire perimeter of the respective panels.

4. A panel wall construction comprising a pair of panels arranged with adjacent edges extending parallel and in closely spaced relation to one another, said panels each having a core and a pair of skins on opposite sides of the core defining the exterior surfaces of the panels, an elongate channel member extending between and receiving the adjacent edges of said panels and forming a joint between the panels, said channel member having respective pairs of opposing legs spaced apart a distance corresponding to the thickness of the panels and receiving a respective panel therebetween, and means located between said pairs of opposing legs and defining respective abutments for limiting how far the panels may be received in the channel member, said panels which are received by said channel member having the core thereof recessed inwardly from the edges of the skins, with the skins extending into said channel member to a depth so that the edges of the skins thereof engage said abutments and with outer surface portions of the skins being positioned in opposing contacting relation with inner surface portions of the adjacent legs of the channel member, and with the recessed core forming an internal cavity extending longitudinally of the channel member, and an expanded foam filler material filling said internal cavity and also extending between said opposing contacting surface portions of the skins and the adjacent legs and adhering thereto and filling any cracks or gaps which may exist between the channel member and the skins of the panels so as to produce an airtight seal at the joint between the pair of panels, and also forming a bond between the panels and the channel member to provide enhanced structural strength in the joint.

5. A panel wall construction as set forth in claim 4 including at least one hole formed in said channel member and communicating with said longitudinally extending internal cavity to permit injecting the filler material into the cavity.

6. A panel wall construction as set forth in claim 4 wherein the core of said panels comprises an insulating material, and wherein said filler material comprises an expanded foam insulating material filling said cavity and adhering to said channel member and to the panels and forming a bond therebetween to provide enhanced structural strength in the joint.

7. A panel wall construction as set forth in claim 4 wherein the core of each panel is recessed from the edges of the skins a distance less than the depth of the opposing legs of the channel member so that said longitudinally extending internal cavity is wholly located between said opposing legs.

8. A panel wall construction as set forth in claim 4 wherein said pairs of said opposing legs of the channel member extend in longitudinal alignment with one another for interconnecting the pair of panels in longitudinal alignment with one another.

9. A panel wall construction as set forth in claim 4 wherein one pair of said opposing legs of the channel members extends at right angles to the other pair of opposing legs for interconnecting the pair of panels at right angles to one another.

10. A panel wall construction as set forth in claim 4 including respective additional channel members extending along each of the remaining edges of said panels, each of said additional channel members having a pair of opposing legs receiving the edge of the respective panel therebetween, each pair of opposing legs being spaced apart a distance corresponding to the thickness of the panel for closely receiving the panel therebetween, the edges of said panels which are received by said additional channel members having the core thereof recessed inwardly from the edges of the skins, with the skins extending into the respective channel members and positioned in opposing contacting relation with the adjacent legs of the channel member, and with the recessed core forming an elongate internal cavity extending longitudinally of the channel member, and wherein the respective elongate cavities formed in the channel members along the perimeter of each panel are interconnected at opposite ends and communicate along the perimeter of the panel, and wherein said hardened filler material fills said interconnected cavities.

11. A panel wall construction comprising a pair of insulated panels arranged with adjacent edges extending parallel and in closely spaced relation to one another, said panels each having an insulating core and a pair of parallel skins on opposite sides of the core defining the exterior surfaces of the panels, an elongate channel member extending between and receiving the adjacent edges of said panels and forming a joint between the panels, said channel member having respective pairs of opposing legs spaced apart a distance corresponding to the thickness of the panels and extending along the edge of the panel overlying the outside surfaces of the skins and receiving a respective panel therebetween, the longitudinal edges of said panels which are received by said channel member having the insulating core thereof recessed inwardly from the edges of the skins, with the skins extending into said channel member and positioned in opposing contacting relation with the adjacent legs of the channel member, and with the recessed core of each panel forming an internal cavity extending longitudinally of the channel member, one pair of said opposing legs of the channel member extending at right angles to the other pair for interconnecting the pair of panels at right angles to one another, and the respective web portions extending between and interconnecting the opposing legs of each pair, and wherein the web portion for one pair of legs also serves as one of the legs of the other pair, and wherein said panels are received in the channel member to a depth so that the edges of the skins thereof engage said web portions, with the recessed cores of the panels spaced from the web portion and forming respective longitudinally extending cavities on opposite sides of said one web portion, and a hardened expanded foam insulating material filling said internal cavity and also filling any cracks or gaps which may exist between the opposing surface portions of the legs of said channel member and the adjacent portions of the skins of the panels to thereby produce an airtight seal at the joint between the pair of panels, and said expanded foam insulating material adhering to and forming a bond between said channel member and the panels to thereby provide enhanced structural strength in the joint.

12. A panel wall construction as set forth in claim 11 wherein said panels have an insulating core formed of urethane foam and skins formed of sheet metal bonded to the urethane foam core.

13. A panel wall construction as set forth in claim 11 wherein said panels have an insulating core comprising fiberglass insulation and skins formed of sheet metal mounted in spaced apart relation on opposite sides of the fiberglass insulation.

14. A panel wall construction as set forth in claim 11 wherein said channel member is of a generally H-shaped cross section, with the pairs of opposing legs extending in longitudinal alignment for interconnecting the panels in longitudinal alignment with one another, and including a web portion extending between and interconnecting the pairs of opposing legs, and wherein said panels are received in the channel member to a depth so that the edges of the skins thereof engage said web portion with the recessed cores of the panels spaced from the web portion to form respective longitudinally extending cavities on opposite sides of said web portion.

15. A panel wall construction as set forth in claim 11 wherein said channel member is of a generally H-shaped cross section, with the pairs of opposing legs extending in longitudinal alignment for interconnecting the panels in longitudinal alignment with one another, and including a web portion extending between and interconnecting the pairs of opposing legs, and respective pairs of abutment stops carried by the legs and spaced outwardly from said web portion, and wherein said panels are received in the channel member to a depth so that the edges of the skins thereof engage said abutment stops with the recessed cores of the panels spaced from the web portion to form respective longitudinally extending cavities on opposite sides of said web portion.

16. An insulated building construction comprising a plurality of insulated panels arranged to form an enclosure having side walls and a roof, said panels each having an insulating core and a pair of parallel skins on opposite sides of the core defining the exterior surfaces of the panels, respective elongate channel members extending along the perimeter of each panel and receiving the adjacent edges of said panels and forming respective joints between the panels, said channel members each having respective pairs of opposing legs spaced apart a distance corresponding to the thickness of the panels and closely receiving the respective panels therebetween, the edges of said panels which are received by said channel members having the insulating core thereof recessed inwardly from the edges of the skins, with the skins extending into the channel member and positioned in opposing contacting relation with the adjacent legs of the channel member, and with the recessed core of the respective panels forming a respective internal cavity extending longitudinally of the channel member, and with the respective elongate internal cavities formed along the perimeter of a panel being interconnected at opposite ends and communicating along the perimeter of the panel, and a hardened expanded foam insulating material filling said internal cavities and also filling any cracks or gaps which may exist between the channel members and the skins of the panels to thereby produce an airtight seal at the joints between adjacent panels, and said insulating material forming a bond between the channel member and the panels to thereby provide enhanced structural strength in the joint.

17. A panel wall construction comprising a pair of panels arranged with adjacent edges extending parallel and in closely spaced relation to one another, said panels each having a core and a pair of skins on opposite sides of the core defining the exterior surfaces of the panels, an elongate channel member extending between and receiving the adjacent edges of said panels and forming a joint between the panels, said channel member having respective pairs of opposing legs spaced apart a distance corresponding to the thickness of the panels, each pair of legs receiving a respective panel therebetween, and said channel member including a web portion extending between and interconnecting at least one of said pairs of opposing legs, said panels which are received by said channel member having the core thereof recessed inwardly from the edges of the skins, with the skins extending into said channel member and positioned in opposing contacting relation with the adjacent legs of the channel member, and with the recessed cores of the respective panels which are received by said channel member forming respective internal cavities extending longitudinally of the channel member on opposite sides of said web portion, at least one hole formed in said channel member and penetrating said web portion and communicating with the respective cavities on opposite sides of said web portion to permit injecting a filler material into the respective cavities, and a filler material filling said internal cavities of the respective panels and also filling any cracks or gaps which may exist between the channel member and the skins of the respective panels so as to produce an airtight seal at the joint between the pair of panels.

* * * * *